US005518336A

United States Patent [19]

Arm et al.

[11] Patent Number: 5,518,336

[45] Date of Patent: May 21, 1996

[54] DRAINAGE GUTTER AND METHOD OF INSTALLING

[75] Inventors: Wolfgang Arm, Rendsburg; Heino Messerschmidt, Lütjenwestedt, both of Germany

[73] Assignee: ACO Severin Ahlmann GmbH & Co. KG, Germany

[21] Appl. No.: 356,213

[22] PCT Filed: Apr. 28, 1994

[86] PCT No.: PCT/EP94/01354

§ 371 Date: Jan. 30, 1995

§ 102(e) Date: Jan. 30, 1995

[87] PCT Pub. No.: WO94/25694

PCT Pub. Date: Nov. 10, 1994

[30] Foreign Application Priority Data

Apr. 28, 1993 [DE] Germany ..... 43 13 956.6

[51] Int. Cl.[6] ..... E01C 11/22

[52] U.S. Cl. ..... 404/2; 404/3; 404/5

[58] Field of Search ..... 52/169.5; 404/2, 404/3, 4, 5; 405/118, 119, 120, 121

[56] References Cited

FOREIGN PATENT DOCUMENTS 0357895 3/1990 European Pat. Off. .

8807858 9/1988 Germany .

8911111 1/1990 Germany .

9000569 4/1990 Germany .

9102219 6/1991 Germany .

*Primary Examiner*—Ramon S. Britts

*Assistant Examiner*—Pamela A. O'Connor

*Attorney, Agent, or Firm*—Rothwell, Figg, Ernst & Kurz

[57] ABSTRACT

Drainage gutters for installation in the ground are known which comprise a gutter body at the upper edges of which are integrally cast frames into which a cover can be placed. As they are installed in the ground the drainage gutters are sealed from the ground along their upper edges by means of first sealing devices. To produce a watertight seal between each two drainage gutters that abut one another by their end faces, second sealing devices are provided. These sealing devices each comprise grooves that can be filled with a sealant. The known drainage gutters are not completely watertight with respect to the ground. It is proposed to provide connecting channels between the first and the second grooves, so constructed that the sealant of the first sealing devices can be introduced so as to be continuous with the sealant of the second sealing devices by way of a complete or integral transition region. In addition, instead of a bulk sealant, a compressed continuous sealing strip is used which, in the region of the connecting channels or chambers, comes into contact with the sealant of the first sealing devices (FIG. 5).

19 Claims, 6 Drawing Sheets

DRAINAGE GUTTER AND METHOD OF INSTALLING

DESCRIPTION

Figure 1:
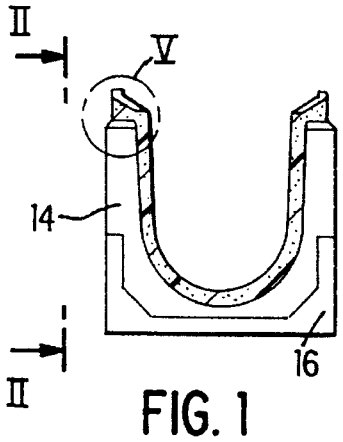

The invention relates to a drainage gutter and a method of installing such a gutter according to the precharacterizing clause of claims 1, 15 and 19.

A drainage gutter according to the present invention is characterized in that it can be installed in such a way as to be completely leakproof with respect to the surrounding ground under the most diverse weather conditions.

German patent DE-OS 23 47 869 discloses a drainage gutter that can be sealed off from another gutter at its ends with a fitting sealing-element insert. During installation the sealing element must be pushed over a thickened part into a correspondingly shaped cavity, with the risk of damage to the sealing element and subsequent leakage. Furthermore, although a sealing element of this kind seals off the interior of the gutter from its outer surface, it does not prevent overflow into the surrounding ground. That is, liquid that is supposed to be drained away can enter the ground between the ground surface and the edge of the gutter.

DE 91 02 219 U1 discloses a drainage gutter of the kind mentioned at the outset. In this known drainage gutter, in addition to a seal at the ends of the gutter there is provided a seal between the longitudinal edge of the gutter and the ground; however, it has been found that liquid to be drained away can still enter the surrounding ground.

DE 90 00 569.4 U1 discloses a drainage gutter with seals or seal profiles inserted at each end of the gutter body, such that when installed the sealing surfaces are pressed together by a tongue-and-groove joint at the opposed end faces of adjacent gutter bodies. Even here, however, problems arise with respect to sealing off the longitudinal edge of the gutter and the transition region between the upper part of the end face and the longitudinal edge.

It is a general problem with the gutters described above, which are fixedly installed in the ground (concrete cast in situ), that eventually leakage sites develop. What is required of such gutters is that they are not only watertight shortly after installation but remain so for a long time, while on the other hand it must be possible to install and repair such gutters or gutter systems with no great effort and under the most diverse weather conditions.

It is therefore the object of the invention to develop a drainage gutter of the kind cited at the outset in such a way as to provide a tight, long-term seal with respect to the surrounding ground by simple means, and to propose a corresponding, simple method of installation.

This object is achieved by the characteristics given in claims 1, 15 and 19, and the subordinate claims comprise useful embodiments and further developments of the invention.

An essential basic concept of the invention is first that the masses of sealant along the gutters are firmly connected to or continuous with the sealant at the ends of the gutters, in the region where gutters abut against one another. This measure provides a system, consisting of the surrounding ground surface and the gutters, that is absolutely watertight over a long period of time.

The channels connecting the longitudinal and end-face sealants preferably comprise a channel floor that opens into the first or longitudinal grooves substantially at the level of a lower boundary of these grooves. This arrangement ensures that when the grooves are filled with sealant, on the one hand only the minimal amount that suffices for sealing is required, while on the other hand no disadvantageous pockets of air are formed.

The second grooves are preferably provided in only one end face of the gutter body, which simplifies the manufacture of the gutter bodies. These second grooves are preferably disposed at the outflow end of each gutter. As a result, connecting elements such as inflow boxes, side branches or the like can be constructed more simply, namely without such a groove.

The second grooves can be open toward the inside of the gutter. This arrangement makes the gutters easier to maintain after installation, because defective spots can be detected and filled with sealant material. The arrangement is also advantageous for the initial installation, because it enables visual inspection of the sealant.

The connecting channels are preferably formed in the frames. This simplifies the manufacturing procedure, in which the frames are cast into the gutter body. In this case the connecting channels are disposed in chambers formed in ends of the frames. That is, the connecting channels are closed at the top.

The connecting channels preferably open outward at the end faces of the gutters with which they are associated. Thus when gutters are assembled, at each joint two half connecting channels face one another and together form a channel enclosed on all sides, which extends between the first and the second groove. When these channels are filled by sealant injection, the frames as well as the gutters are completely sealed off at their joints. This applies in particular when the connecting channels are provided in the frames at both ends of the gutter. In this case it is advantageous for the connecting channels each to have a cross-sectional profile corresponding substantially to half the cross section of the second groove.

The effect of this is to ensure that no excessive amounts of sealant are needed.

The first grooves can be closed off at the bottom by a sealing cord, as is known per se from DE 91 02 219 U1. This sealing cord is so constructed that when the sealant adhering to the surrounding parts shrinks, said sealant does not become detached at undesired sites, as can otherwise easily happen with 3-flank adhesion.

The frames are formed so that they stand back somewhat from the gutter body, forming a shoulder. As a result, during installation of the gutters or application of the road surfacing the first grooves can be formed especially easily by means of formwork strips (which are later removed). That is, the shoulder provides a precise depth guide for these formwork strips.

According to a further basic concept of the invention, the opposed end faces of the gutter body are so formed, i.e. provided with grooves, that they can receive a preferably profiled continuous sealing strip.

During the installation of the gutter bodies the continuous sealing strip is compressed, as a result of which it protrudes in the region of the frame or at the upper part of the gutter body. Protrusion of the sealing material serves as a visible criterion for a sufficiently tight seal or a corresponding compressive force, with no need to damage or destroy the sealing material itself.

When the compression process has been completed, the protruding ends of the sealing material are detached, in particular cut off.

As the longitudinal sealant is introduced through the first groove and the chamber of the connecting channel, it comes to rest against the remaining part of the continuous sealing strip, sealing the gutter body off completely from the surrounding ground, e.g. the road surfacing.

The sealing or compression pressure is generated, for example, by screwing together pressure plates in the manner of a flange gasket, or by compression with an accessory device followed by screwless fixation by means of wedge-shaped slides.

If repairs are needed, the continuous sealing strip can be removed from the second groove and, according to the first concept of the invention, by way of this groove there can be introduced end-face sealant, in particular an end-face sealant with adhesive action.

Corner, T and cross pieces with integrally formed flange can likewise be used to generate the compression pressure, and these can for example be provided with screw-in pressure plates or wedge-shaped slides by means of which such pieces are disposed in the gutter system. Alternatively, the corner, T and cross pieces can be connected directly to elastic end-face sealant and adhesive material, in which case the chamber and the second groove constitute useful surfaces for adhesion.

Figure 2:
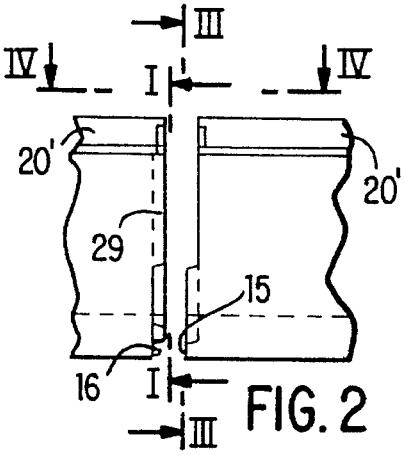
Figure 3:
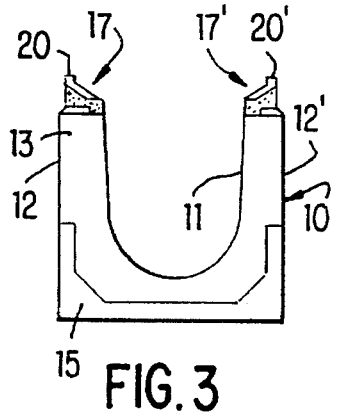
Figure 4:
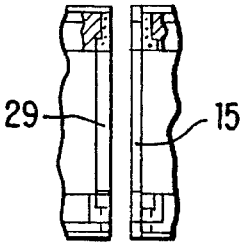
Figure 5:
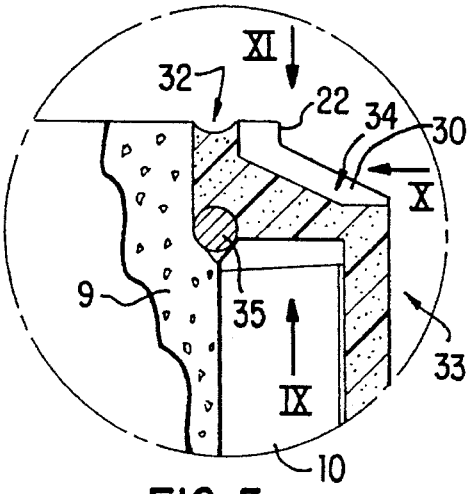
Figure 7:
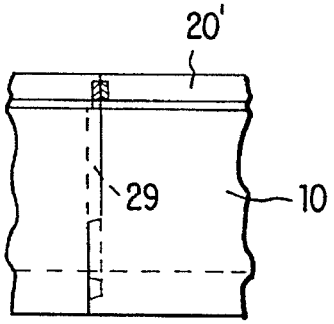
Figure 6:
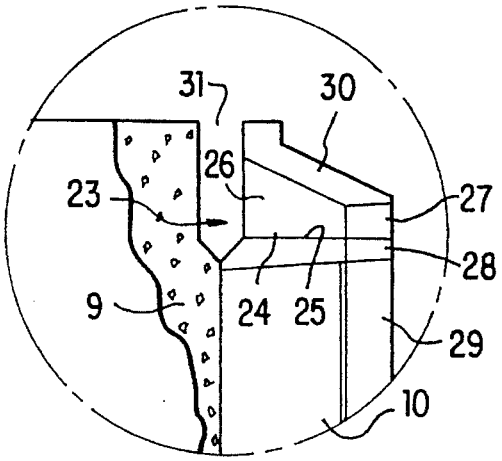
Figure 8:
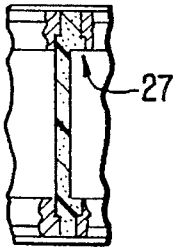
Figure 9:
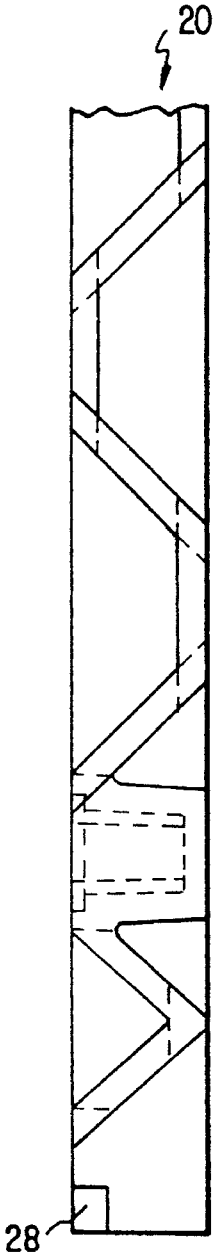
Figure 10:
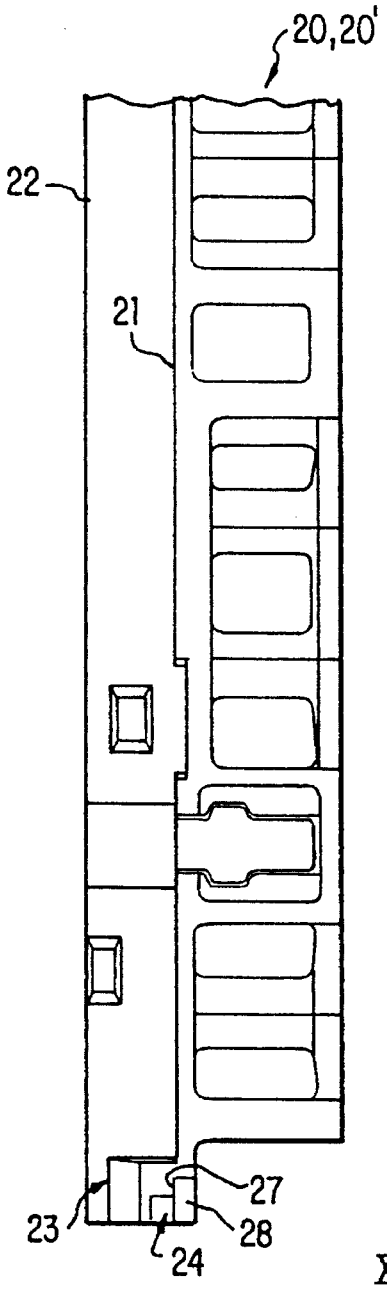

Preferred embodiments of the invention derive from the subordinate claims. In the following, preferred embodiments of the invention are described in detail with reference to drawings, wherein FIG. 1 is a surface view of an end face at the outflow end of a gutter, FIG. 2 is a side view along the line II—II in FIG. 1, in which two gutters have not yet been completely pushed together, FIG. 3 is a surface view of an end face at the inflow end, along the line III—III, FIG. 4 is a view along the line IV—IV in FIG. 2, FIG. 5 is an enlargement of the circled section of FIG. 1, showing an installed gutter, FIG. 6 is the same view as in FIG. 5, but before sealant has been introduced, FIG. 7 is a view similar to that of FIG. 2, except that the two gutters are in contact with one another, FIG. 8 is a view corresponding to that of FIG. 4, with the gutters in contact with one another, FIGS. 9 to 11 show a frame as seen from the directions IX–XI in FIG. 5

Figure 12:
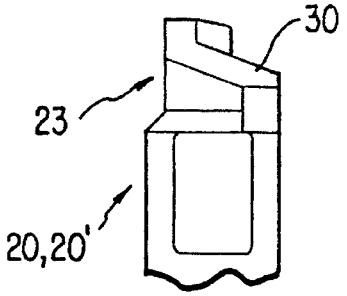
Figure 11:
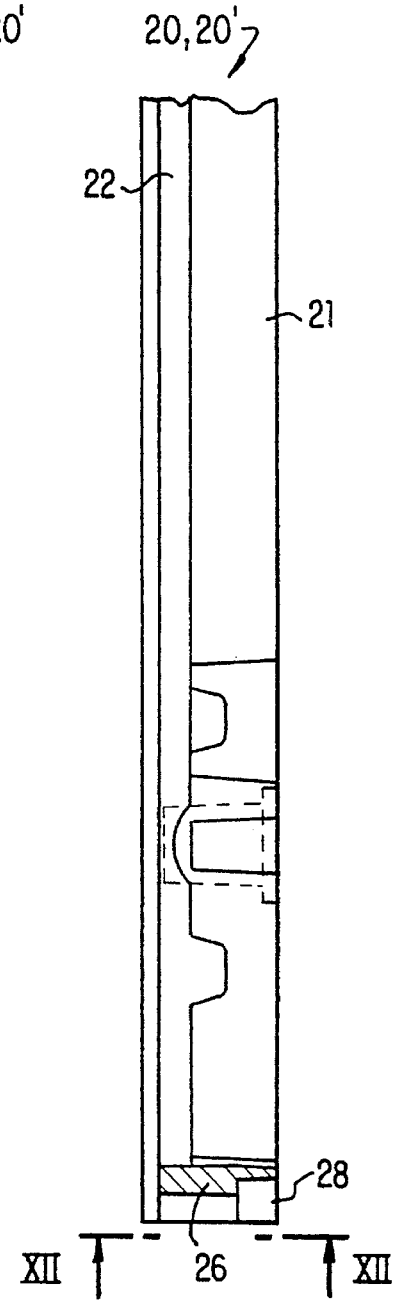
Figure 14:
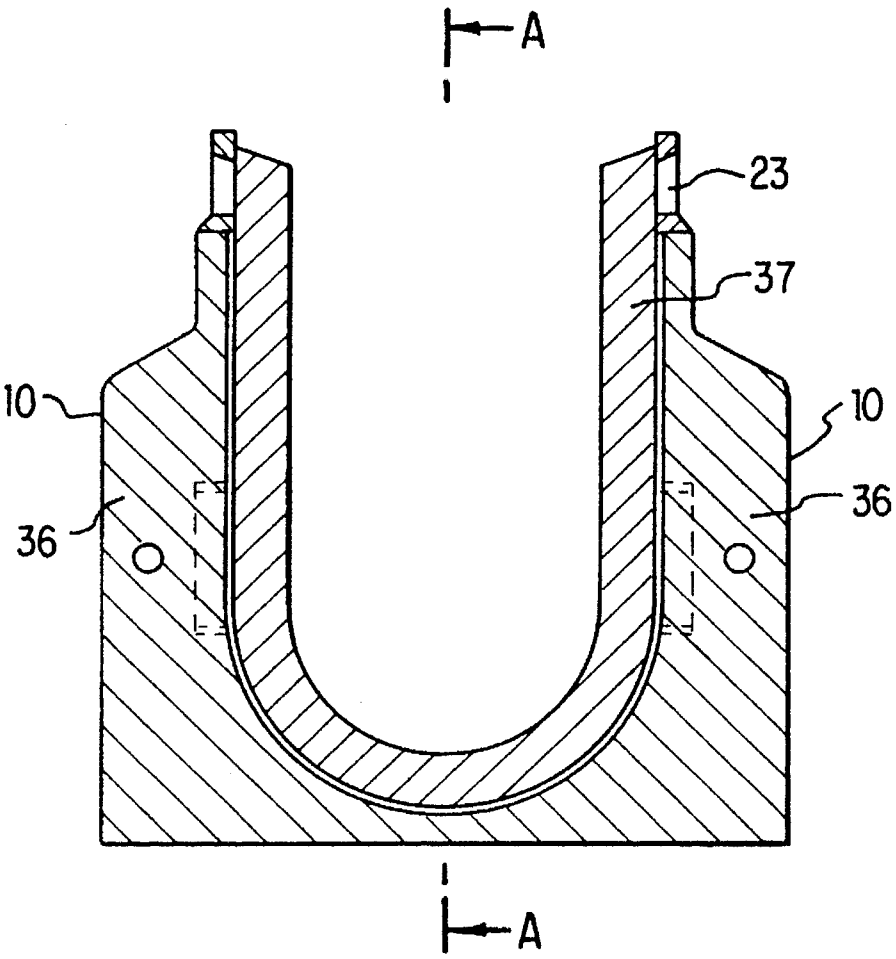
Figure 13:
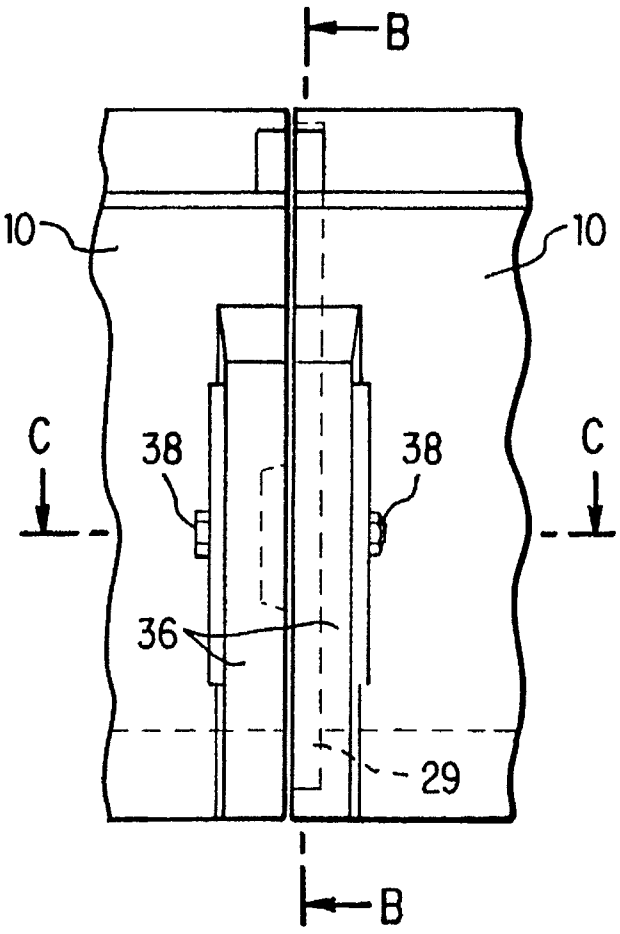
Figure 17B:
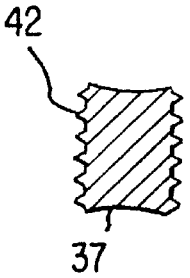
Figure 17A:
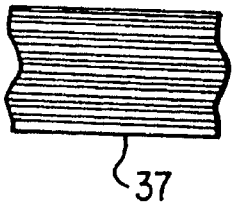
Figure 16:
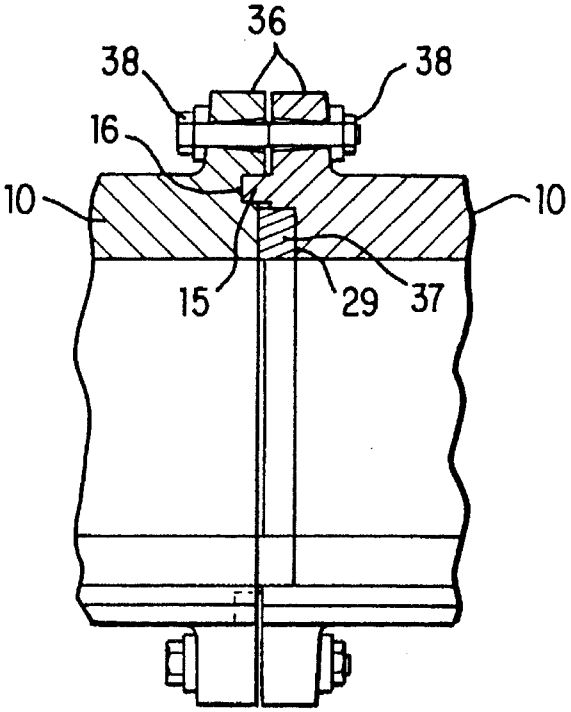
Figure 15:
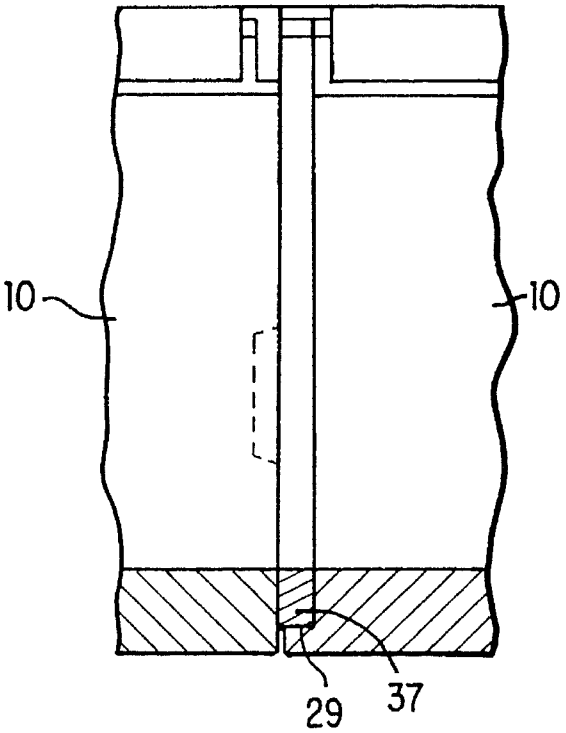
Figure 19:
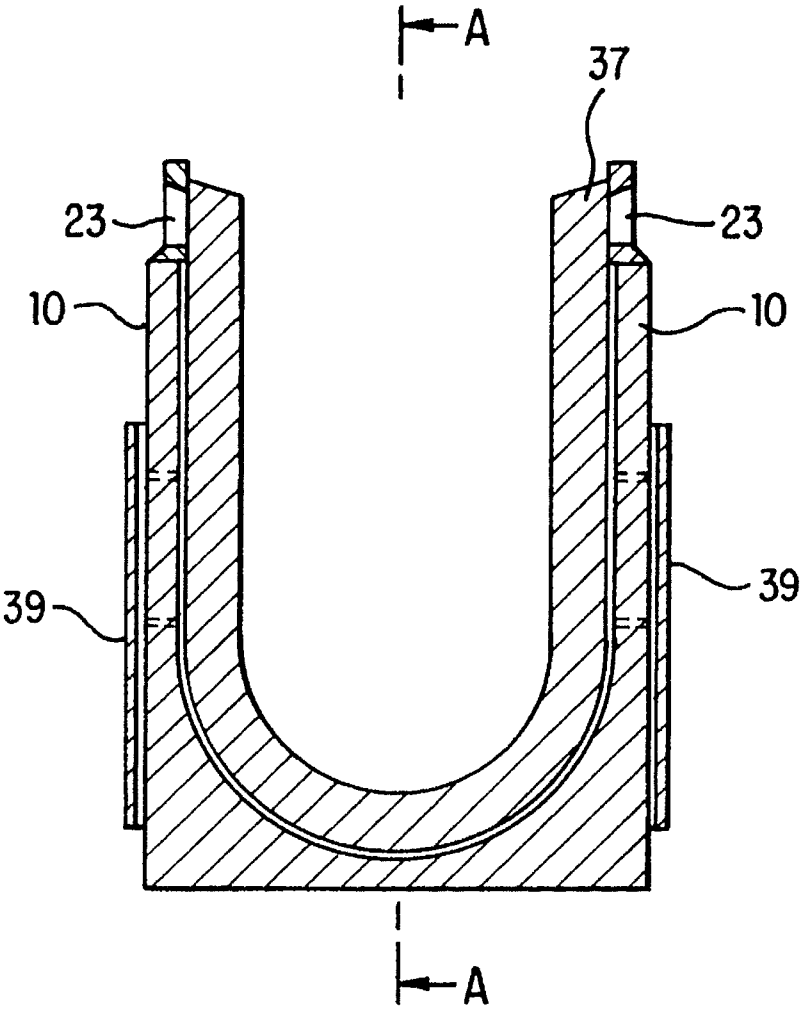
Figure 18:
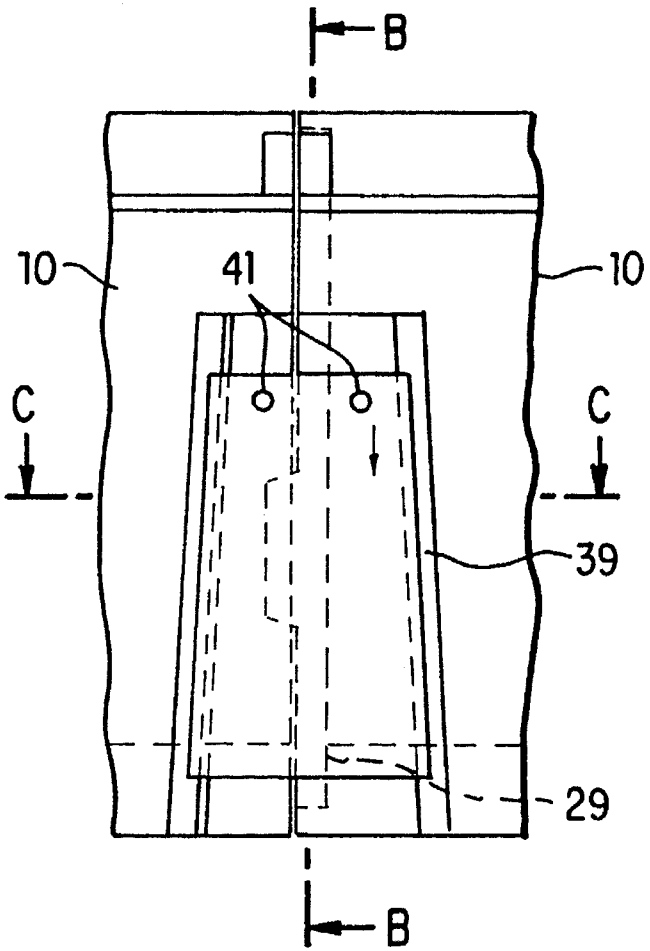
Figure 21:
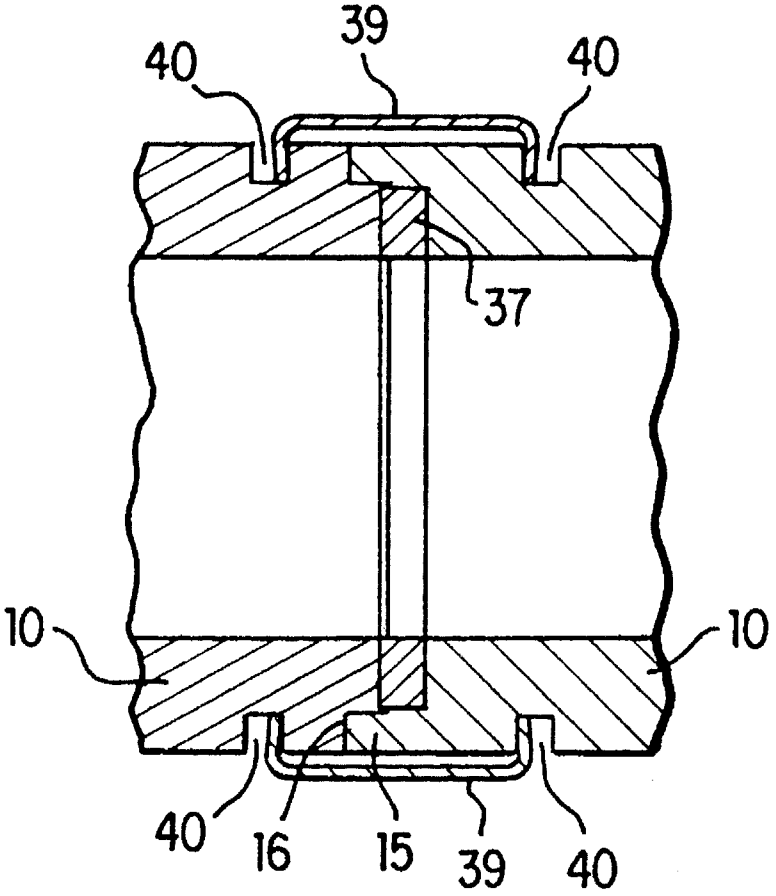
Figure 20:
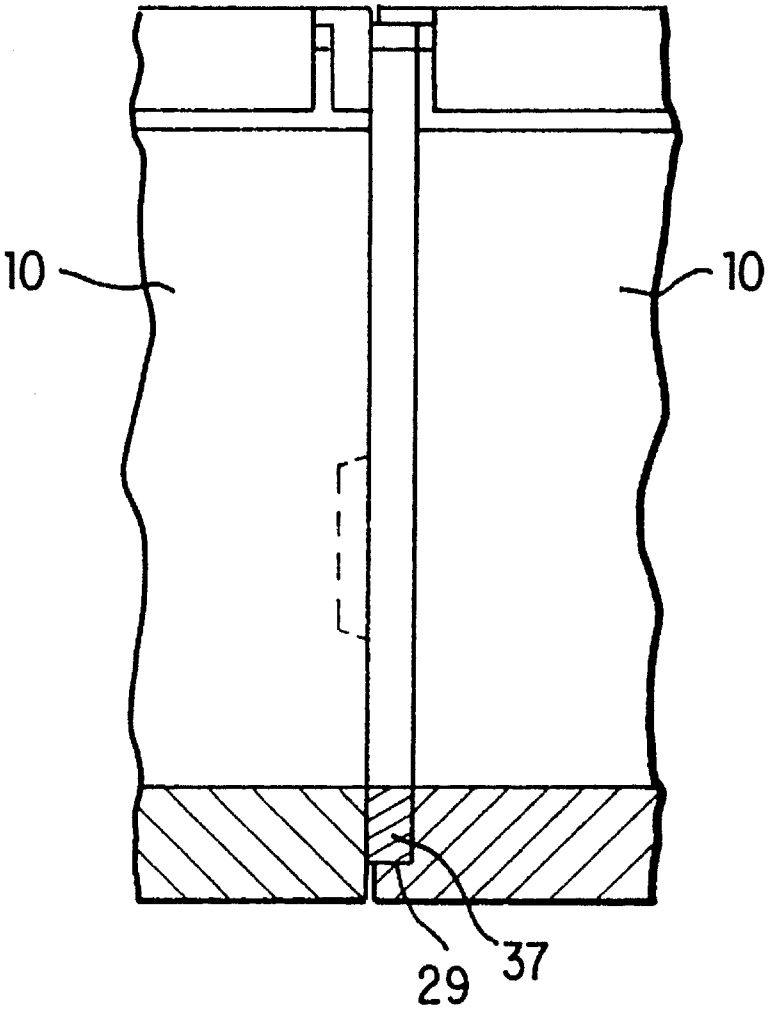

FIG. 12 is a view of the frame according to FIG. 11 along the line XII—XII, FIG. 13 is a side view of two gutter-body parts with screw flange and second groove for a continuous sealing strip, FIG. 14 is a view along the line B—B in FIG. 13, with continuous sealing strip already cut off at its upper end, FIG. 15 is a view along the line A—A in FIG. 14, with continuous sealing strip in the second groove, FIG. 16 shows a section along the line C—C in FIG. 13, FIGS. 17*a*, 17*b* show an embodiment of a profiled continuous sealing strip in side view (a) and in cross section (b), FIG. 18 is a side view of two gutter-body parts with sliding-wedge fastening and second groove for a continuous sealing strip, FIG. 19 is a view along the line B—B in FIG. 18, with continuous sealing strip already cut off at the upper ends, FIG. 20 is a view along the line A—A in FIG. 19 with continuous sealing strip in the second groove, and FIG. 21 shows a section along the line C—C in FIG. 18 with wedge-shaped slide.

In the following description identical reference numerals are used for the same parts or parts with the same action.

In the embodiments of the invention shown in FIGS. 1–12 a gutter body 10, preferably made of concrete polymer, is provided at its upper edges 17, 17' with frames 20, 20'. The frames 20, 20' are preferably constructed substantially (except for the end regions described below) according to EP 0 081 762 B1. Gutter constructions of this kind are thus known in principle.

A grating (not shown) can be placed onto the gutter body or its upper edge 17, 17' in such a way that it rests on bearing surfaces 21 (FIGS. 10, 11) and is secured against sideways slippage by a rim 22 of the frames.

At each end of the frames 20, 20' is formed a chamber 23 (FIGS. 6, 10, 12) that is elevated above the bearing surface 21, so that the gratings to be placed on the latter surface must be provided with a correspondingly shaped recess. The chamber 23 comprises an upper wall set at an angle to the interior of the gutter body 10, which forms the top wall 30 of a channel (FIGS. 5, 6, 12). Toward the middle of the gutter the chamber is closed off by a wall that forms the back wall 26 of the channel (FIG. 6, 11). A channel floor 25 is formed by a continuation of the frame section that constitutes the bearing surface 21.

Toward the inside of the gutter there is provided a groove window 28 (FIGS. 6, 9–11), so that the chamber 23 forms a connecting channel 24 that is open toward the inside of the gutter body 10 as well as toward the outside, passing through the frame rim 22.

The groove window 28 is not exactly flush with the connecting channel 24 but extends backward, away from the end of the gutter, in the region of an offset shoulder 27. The cross sectional area of the groove window 28 corresponds substantially to double the cross-sectional area of the connecting channel 24 (which opens forward, i.e. toward the end face of the gutter body 10) at the place where its vertical dimension is smallest, as defined by the height of the top channel wall 30.

The gutter body 10 comprises (in a manner known per se) an inflow end face 13 at its inflow end and an outflow end face 14 at its outflow end. The inflow end face 13 is provided with a projection 15 (in the lower region), and there is a correspondingly shaped recess 16 in the outflow end face 14, so that when the two end faces 13, 14 are put together, they insert into one another in a form-fitting manner.

In the outflow end face 14 there is additionally provided an end-face second groove 29, which is open both toward the inside wall 11 of the gutter body 10 (FIGS. 1–12) and toward its end. The end-face second groove 29 is continuous (flush and identical in cross section) with the groove window 28 of the chamber 23 at the outflow end of the frames 20, 20'.

Now when two gutters are put together in such a way that an inflow end face 13 of one is opposed to an outflow end face 14 of the other, the two connecting channels 24, each of which is open on one side, are aligned so as to form a channel closed on all sides and having double the cross-sectional area. In addition, the end-face second groove 29 in the outflow end face 14, which is open toward the end of the gutter body 10, is closed off by the opposed inflow end face 13 (which has no groove), so that a U-shaped groove is formed within the inside wall 11 of the gutter after adjacent gutter bodies have been put together.

The drainage gutters so constructed are assembled to form a complete "canal" installed in the ground (in concrete poured in situ). The (road) surfacing 9 (see FIG. 5) is then applied to appropriately provided lower layers in such a way that its surface is level with the top of the frame 20, i.e. with the upper edge of the frame rim 22. Before this surfacing is applied, however, a formwork strip is placed next to the outside of the frames 20, 20', the outer surfaces of the frames 20, 20' being set back, by way of a slanted segment, from their lower edges, which are flush with the outer wall 12, 12' of the gutter body 10 (see FIG. 3). This arrangement provides a space within which the formwork strip can easily be fixed. The formwork strip is preferably produced with a width corresponding to twice the distance by which the outer surfaces of the frames 20, 20' are set back, and at its bottom edge there is a V-shaped section corresponding to the slanted segment of the frames. When the formwork strip is later removed, there is produced a longitudinal groove 31 along each longitudinal side of the gutter (see FIG. 6).

Into the longitudinal first groove 31 so formed is placed a sealing cord 35 that runs the length of the gutter in the bottom of the longitudinal groove 31, where it is fixed due to the V shape and protrudes only slightly above the channel floor 25.

Then sealing material is pressed (in a manner known per se) into the longitudinal first grooves 31 and thence into the connecting channels 24. As a bead of sealing material emerges into the interior of the gutter body 10, it is redirected into the end-face second grooves 29. The longitudinal first grooves 31 are thus completely filled with a longitudinal sealant 32 that is continuous (integral) with end-face sealant 33 in the end-face second grooves 29 by way of the transition region 34 (see FIG. 5). As a result, the gutters (with their frames 20) are tightly joined to the road surfacing 9, while the joints of the frames 20, 20' as well as the gutter bodies 10 themselves are likewise joined to one another in a leakproof manner and glued together because of the adhesive property of the sealing material. The sealing cord 35 at the lower boundary of the longitudinal first groove 31 prevents 3-flank adhesion, which could cause uncontrolled detachment of the sealing material as it hardens (and shrinks). The sealing grooves—i.e., the longitudinal first grooves 31 as well as the end-face second grooves 29 and the connecting channel 24—are all provided with rectangular side surfaces so as to ensure optimal filling and contact with the sealing material.

Because all the grooves are open, the process of filling them can be well observed, so that faultless sealing is guaranteed.

Fractures or flaws in the material, which can develop after it has been in use for a very long time, are also easily visible from outside. Because the grooves are all externally accessible, the system is very easy to repair.

FIG. 13 is a side view of two gutter bodies 10 provided with a screw flange 36 and a second groove 29 to receive a preferably profiled continuous sealing strip 37 (see FIG. 14).

The screw flange 36 includes a bore on each side to receive a screw or bolt 38.

By means of the screw flange 36 and the screw connection 38, a compressive force is exerted on the continuous sealing strip 37 within the second groove 29.

As can be seen in FIG. 16, the thickness of the continuous sealing strip 37 is made such that in the uncompressed state of the screw flange 36 it protrudes from the second groove 29 and comes into contact with the opposed end face.

Because the second grooves 29 as shown in FIG. 14 are open upward, when the screw connection 38 is tightened the material of the continuous sealing strip 37 expands or moves so as to emerge from the upward opening of the second groove 29. Its emergence serves as a measure of the compressive force, with no need for other accessories, so that there is no risk of damaging the seal by excessive pressure.

After the compression process has been completed, the protruding ends of the sealing material comprising the continuous sealing strip 37 are removed, a practical means being to cut them off.

When the longitudinal sealant is subsequently introduced, it can come into contact with the material of the continuous sealing strip 37 by way of the chamber 23, whereupon the two sealing elements can combine with one another to provide high security against leakage in the transition region between the end-face and longitudinal seals.

As a result of the specially profiled shape of the continuous sealing strip, shown from the side in FIG. 17*a* and in cross section in FIG. 17*b*, the injected sealing material can migrate uniformly and emerge at the upper end of the continuous sealing strip in the second groove without forming cracks.

At the surfaces to be sealed, as shown in FIG. 17*b*, the profiled continuous sealing strip is provided with tooth-like projections, elevations or toothed profiles 42, which improves the sliding and sealing behavior as described above.

FIG. 15, which gives a view along the line A—A in FIG. 14, shows how the continuous sealing strip 37 in the second groove 29 is disposed like a flange gasket but with the difference, which is essential to the invention, that as the compressive force is generated, the sealing material can migrate upward and out of the groove, which serves both to simplify the assembly procedure and to make the joint leakproof for a sufficiently long time.

It will be immediately apparent that insertion of a profiled continuous sealing strip, or a piece of material precut to more than the required length from a continuous sealing strip, is considerably simpler and less complicated than the installation of a form-fitted seal which in addition has to be slipped over a thickened region.

The emergence of the material of the continuous sealing strip 37 at the top of its groove is visible proof that the strip covers the region of the chamber 23, and ensures that the longitudinal sealant later to be introduced will make adequate contact with the material of the continuous sealing strip 37.

FIG. 16, which shows a section along the line C—C in FIG. 13, illustrates the screw or bolt connection mentioned above, which comprises the flange 36 and a screw or bolt 38 with associated nuts.

FIG. 18 shows a second embodiment of the gutter-sealing system with continuous sealing strip, in which two gutter bodies 10 such as are shown in cross section in FIG. 19 are pressed together with an accessory device (not shown) and subsequently secured by means of the wedge-shaped slide 39. Alternatively, however, the necessary compressive force can also be produced by pressing on the wedge-shaped slide 39 in the direction of the arrow.

The configuration of the sliding-wedge fastener is shown again in FIG. 21, as seen in section along the line C—C in FIG. 18. This drawing also shows the above-mentioned projection 15 and recess 16 provided to ensure precise alignment of the gutter bodies 10 when installed and to serve as an additional locking device.

When grooves 40 are provided in the gutter body to receive the wedge-shaped slide 39, as shown in FIGS. 18 to 21, this arrangement involves only an insignificant change in overall size, in particular in the width of the gutter body. At the upper end of the wedge-shaped slide 39 apertures 41 can be provided to enable simple disassembly of the gutter system. For this purpose a correspondingly shaped, e.g. hook-shaped tool is introduced from above and the wedge-shaped slide is pulled up and away from the gutter.

It is within the scope of the invention that the installation steps in which the continuous strip of profiled sealing material or a pre-cut piece thereof is set into the second grooves of the end faces of the gutter body and subsequently compressed can be combined with the introduction of the longitudinal sealant through longitudinal grooves. In case repair is required, the material of the continuous sealing strip can be removed by loosening the wedge or screw fastening and new sealing material can be drawn in, or an appropriately viscous end-face sealant can be injected into the existing groove.

A further advantage of the chosen principle of flange sealing with a profiled continuous sealing strip, in addition to maximizing the tightness of the seal, is that compression by means of a screw flange or wedge-shaped slide provides extra stabilization of the whole gutter system.

The invention is primarily intended for drainage gutters with reinforcing frames at their upper edges, in which the chambers 23 that constitute the connecting channel 24 are integrally formed during casting. In principle, however, the invention can also be applied to drainage gutters with other configurations, as long as it is ensured that the masses of longitudinal sealant 32 can pass through transition regions 34 so as to be continuous with the end-face sealant 33 or the continuous sealing strip 37, with the result that the seals produced at the gutter joints are continuous up to the top edge of the gutters or the road surface and the liquid to be drained away— e.g., water, chemicals or the like—cannot penetrate into the soil at any point.

By the use of a compressed continuous sealing strip to seal the end faces of the gutters, installation of the gutter bodies on site is made largely independent of the weather, which affects the hardening of other forms of sealant, while all criteria for maximal watertightness are met.

| List of reference numerals | |
|---|---|
| 9 | Road surfacing |
| 10 | Gutter body |
| 11 | Inside wall |
| 12, 12' | Outside wall |
| 13 | Inflow end face |
| 14 | Outflow end face |
| 15 | Projection |
| 16 | Recess |
| 17, 17' | Upper edge |
| 20, 20' | Frames |
| 21 | Bearing surface |
| 22 | Frame rim |
| 23 | Chamber |
| 24 | Connecting channel |
| 25 | Channel floor |
| 26 | Back wall of channel |
| 27 | Offset edge |
| 28 | Groove window |
| 29 | End-face groove (second groove) |
| 30 | Top wall of channel |
| 31 | Longitudinal groove (first groove) |
| 32 | Longitudinal sealant |
| 33 | End-face sealant |
| 34 | Transition region |
| 35 | Sealing cord |
| 36 | Screw flange |

-continued

| List of reference numerals | |
|---|---|
| 37 | Continuous sealing strip |
| 38 | Screw or bolt fastening |
| 39 | Wedge-shaped slide |
| 40 | Groove |
| 41 | Apertures |
| 42 | Elevations (toothed profiles) |

We claim:

1. Drainage gutter for installation in the ground, with a gutter body having frames having on its upper edges, with first sealing devices to produce a watertight seal between the drainage gutter along its upper edges and the ground, and with second sealing devices to produce a watertight seal between adjacent drainage gutters disposed with their end faces abutting, wherein the sealing devices comprise first grooves and second grooves that can be filled with a sealant, characterized by connecting channels between the first grooves of the first sealing device and the second grooves of the second sealing device, so constructed that the sealant of the first sealing device can be so inserted that it becomes continuous with the sealant of the second sealing device by way of a complete or integral transition region.

2. Drainage gutter according to claim 1, characterized in that the connecting channels comprise a channel floor that opens into the first groove substantially at the level of the lower boundary of the first groove.

3. Drainage gutter according to claim 1, characterized in that the second grooves are provided in only one end face of the gutter body.

4. Drainage gutter according to claim 3, characterized in that the second grooves are provided in the outflow end face.

5. Drainage gutter according to claim 1, characterized in that the second grooves are open toward an inside wall of the gutter body.

6. Drainage gutter according to claim 1, characterized in that the connecting channels are formed in the frames.

7. Drainage gutter according to claim 6, characterized in that the connecting channels are disposed in chambers formed in ends of the frames.

8. Drainage gutter according to claim 1, characterized in that the connecting channels are open toward the end faces.

9. Drainage gutter according to claim 1, characterized in that the connecting channels are provided at both end faces.

10. Drainage gutter according to claim 9, characterized in that the cross-sectional area of each connecting channel corresponds substantially to half the cross-sectional area of the second groove.

11. Drainage gutter according to claim 2, characterized in that the first grooves are closed off in their lowest region by a sealing cord which forms said lower boundary and which is elastic and/or has a surface that does not adhere to the sealant.

12. Drainage gutter according to claim 1, characterized in that the first groove is formed at least partially at the outside edge of the frames.

13. Drainage gutter according claim 12, characterized in that the frames are flush with the gutter body in the region where they make contact with the latter and above this region are set back, by way of a slanting section, to form an edge that extends upward parallel to the outside walls of the gutter body.

14. Drainage gutter according to claim 13, characterized in that the slanting section ends, i.e. the region of the frames parallel to the outside walls begins, at a level corresponding to a floor of the connecting channels.

15. Drainage gutter to be installed in the ground with a gutter body, with first sealing devices to produce a watertight seal between the drainage gutter along its upper edges and the ground, and with second sealing devices to produce a watertight seal between adjacent drainage gutters disposed with their end faces abutting, wherein the sealing devices comprise first grooves and second grooves that serve to receive a sealant, characterized by the arrangement of a compressed continuous sealing strip as the second sealing devices in the second grooves, such that the material of the continuous sealing strip comes into apposition with a chamber or connecting channel and there makes contact with a mass of sealant of the first sealing devices, introduced through the first grooves.

16. Drainage gutter according to claim 15, characterized in that to exert compressive force on the continuous sealing strip there is provided on the gutter body a screw flange to receive a screw or bolt fastener.

17. Drainage gutter according to claim 15, characterized in that in the region of the end faces of the gutter body grooves are provided to receive a wedge-shaped slide.

18. Drainage gutter according to claim 15, characterized in that the continuous sealing strip has a toothed profile over all its sealing surfaces.

19. Method of installing a drainage gutter in the ground, comprising the steps of providing a gutter body with first sealing devices to produce a watertight seal between the drainage gutter along its upper edges and the ground; and with second sealing devices to produce a watertight seal between adjacent drainage gutters disposed with their end faces abutting, wherein the sealing devices comprise first grooves and second grooves that serve to receive a sealant; and wherein an arrangement of a compressed continuous sealing strip is provided as the second sealing devices in the second grooves such that the material of the continuous sealing strip comes into apposition with a chamber or connecting channel and there makes contact with a mass of sealant of the first sealing devices, introduced through the first grooves; said method characterized in that the continuous sealing strip is set or inserted into the second groove, after which the gutter bodies are pressed together in such a way that the material of the continuous sealing strip emerges visibly at the upper end of the upwardly open second groove and the material of the continuous sealing strip is subsequently removed or cut off so that the strip is substantially flush with the upper edge of the gutter body or of a frame disposed thereon, and subsequently end-face sealant is introduced into the first grooves such that the end-face sealant comes into contact with the material of the continuous sealing strip by way of chambers or connecting channels.

* * * * *